United States Patent [19]

Breslow et al.

[11] 4,049,272

[45] Sept. 20, 1977

[54] GAME DEVICE

[75] Inventors: Jeffrey D. Breslow, Highland Park; Eugene Jaworski, Park Ridge, both of Ill.

[73] Assignee: Marvin Glass & Associates, Chicago, Ill.

[21] Appl. No.: 658,025

[22] Filed: Feb. 13, 1976

[51] Int. Cl.[2] ..... A63F 9/14

[52] U.S. Cl. ..... 273/95 R; 273/1 R

[58] Field of Search ..... 273/86 D, 86 C, 1 R, 273/95 C, 95 R

[56] References Cited

U.S. PATENT DOCUMENTS

| | | | |
|---|---|---|---|
| 3,612,527 | 10/1971 | Rogerson | 273/1 R |
| 3,883,137 | 5/1975 | Bengtson | 273/1 R |

*Primary Examiner*—Anton O. Oechsle

*Attorney, Agent, or Firm*—Mason, Kolehmainen, Rathburn & Wyss

[57] ABSTRACT

A game apparatus which includes a base support and a plurality of playing objects for play over and onto the base support. The base support is generally circular and has a generally central funnel shaped receptacle for receiving the playing objects and determining the first of the playing objects to be received therein. A plurality of playing positions are provided on the base support about the receptacle. At least one upstanding standard is provided at each playing position and has a top receiver for positioning thereon one of the playing objects. The playing objects are of a physical character so as to be capable of being blown off of its respective standard by the air exhalation of players of the game from the top of the standards toward and into the receptacle according to appropriate rules of the game.

7 Claims, 2 Drawing Figures

GAME DEVICE

BACKGROUND AND SUMMARY OF THE INVENTION

This invention relates to a game apparatus requiring visual observation and physical reaction thereto as well as physical dexterity so as to gain an object of the invention.

More particularly, there have been many games in which competition is provided due to manual or other physical dexterity of the competitors. The present invention combines the physical characters of the players of the game which include the combination of visual dexterity as well manual dexterity. In particular, the manual dexterity comprises the exhalation of air from the mouth of the competitors so as to move playing objects to a receptable in order to be the first player of the game to have his playing object enter the receptacle.

More particularly, a generally circular base support is provided. A central funnel type receptacle is provided for receive spherical playing objects thereinto so as to determine which spherical object first reaches the bottom of the funnel. The spherical objects are coded, as by color, to the various players of the game. To this end, a plurality of playing positions are provided about the receptacle and include a plurality of upstanding standards on top of which the playing objects, coded per player, are positionable. Each standard has indicia thereat, such as the numerals 1 through 4, which are correlated to a set of playing cards which have indicia, i.e., 1 through 4 whereby the playing of the cards determine from which standard each player must attempt to blow, by exhalation of his own air, the particular playing object on the respective standard toward the receptacle in order to be the first player to have his playing object reach the bottom of the funnel type receptacle.

Of course, other schemes of playing the game are contemplated by the present invention.

Other objects, features and advantages of the invention will be apparent from the following detailed description taken in connection with the accompanying drawings.

DESCRIPTION OF THE PREFERRED EMBODIMENT

Figure 1:
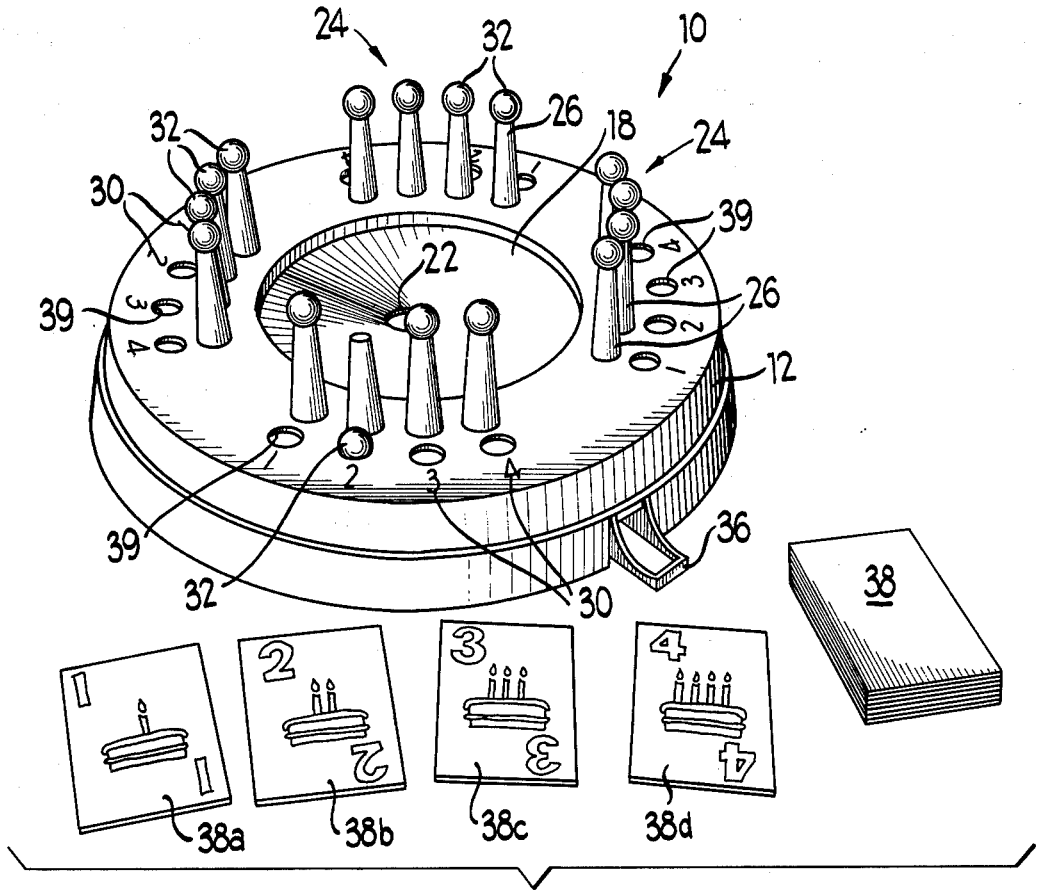
FIG. 1 is a composite perspective view of the game apparatus of the present invention, including card type devices for providing a random play of the game.
Figure 2:
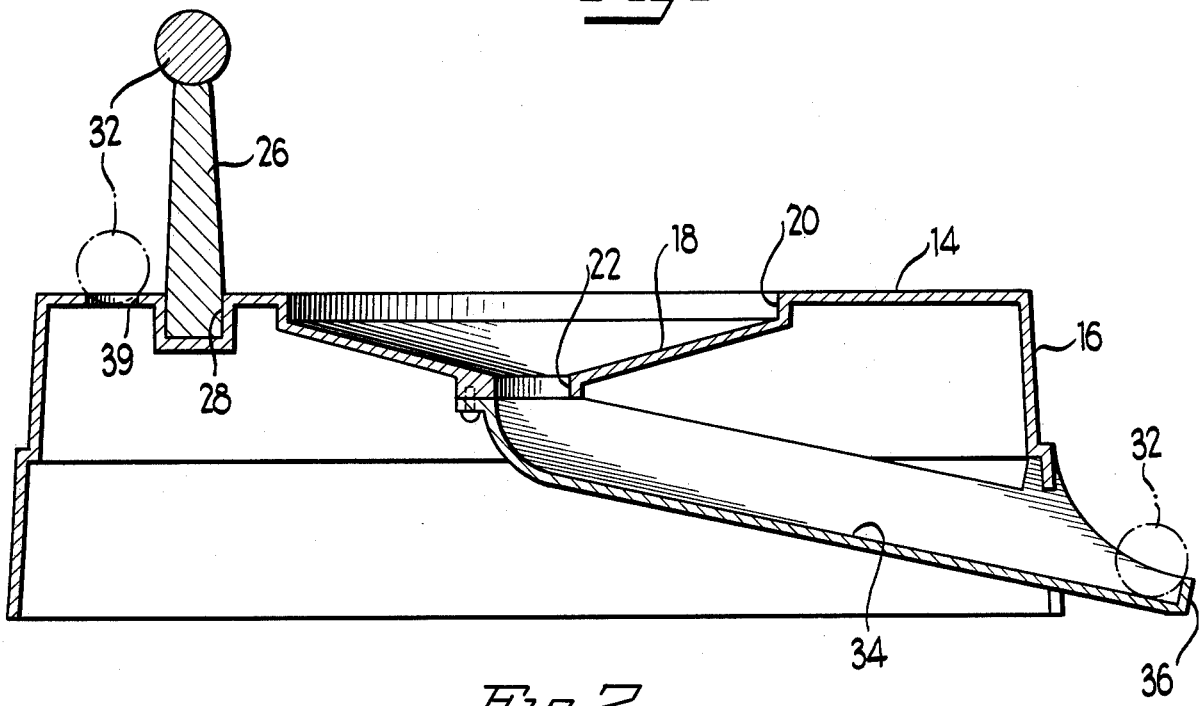
FIG. 2 is a vertical section, on an enlarged scale, through the base support and related components of the game apparatus of the present invention.

Referring to FIG. 1, the game apparatus of the present invention, generally designated 10, includes a base support 12, referred to in FIG. 1, which is generally circular in configuration and, referring to FIG. 2, includes an annular top wall 14 having depending annular side flanges 16 for supporting the base support on appropriate structures such as a table, desk or the like.

The center of the base support includes a funnel or frusto-conical portion 18 which is bounded at its top by a circular flange 20 and terminates at its bottom in an aperture 22. Surrounding this funnel type receptacle are a plurality of playing positions, generally designated 24. Each playing position has a plurality of upright standards 26 which are received in the base support by complementary recesses 28 (see FIG. 2) either by a press fit or an appropriate adhesive. In the exemplary embodiment of the invention, each playing position 24 includes four upright standards 26 and each upright standard has on the base support indicia such as the numerals 30 shown in FIG. 1.

A plurality of playing objects in the form of spherical balls 32 are positionable on top of the upright standards 26 for removal therefrom toward the receptacle in the center of the base support 24 so that the balls can move around the base support toward the aperture 22 and through a chute 34 (see FIG. 2) to a rest position defined by a flange 36.

A set of cards, a deck 38 of which is shown in FIG. 1, includes a plurality of individual cards **38*a* through 38*d* shown in FIG. 1. Of course, various other random determining means are contemplated by the present invention such as the throw of a die. A plurality of recesses 39 are provided on the base support behind each upstanding standard 26 for positioning one of the playing objects 32** therein.

Within the above described structure, one form of playing the game is shown in this particular embodiment. More particularly, four playing positions 24 are provided with four upstanding standards 26 thereat each of which will support a playing object 32 and each of which has a numerical indicia (1 through 4) alongside the position 24 for the playing objects 32.

By utilizing the playing cards **38*a*–38*d* of the stack 38 thereof, a card may be overturned by a player of the game to reveal one of the specific (in this instance, numerical) indicia thereon whereby each of the four players attempts to blow the playing object off of his respective upright standard which corresponds to that indicia into the receptacle 18 so as to be the first to have his playing object (or ball) to pass through the aperture 22 down the chute 34 so as to be indicated the winner of that round. As shown in FIG. 1, the player at the front position already has accomplished that feat and can place his playing object into the 2 position. This procedure continues until one of the players has been able to accomplish filling all of his positions corresponding to the multiple upright standards 26** at his respective position.

Of course, with the structure of the invention disclosed herein, other schemes of play of the game are fully contemplated. For instance, as mentioned above, dice could be employed with the present invention. Many other chance devices could be employed. Furthermore, for instance, the cards from the deck 38 could be turned over seriatim whereby the players would have to contain themselves until two specific numbers were turned over identical in seriatim before any of the players could attempt to blow their playing object off of the respective indicated upright standard.

The foregoing detailed description has been given for clearness of understanding only and no unnecessary limitations should be understood therefrom as some modifications will be obvious to those skilled in the art.

We claim:

1. A game apparatus, comprising:

a base support;

a plurality of playing objects coded for use by multiple players of the game;

means on said base support defining a receptacle for determining the first of said playing objects to be received therein;

a plurality of playing positions on said base support about said receptacle;

a plurality of upstanding standards at each playing position for positioning on top thereof a plurality of said coded playing objects; and said objects being of a physical character so as to be capable of being blown off of its respective standard by the air exhalation by players of the game from the top of the standards toward the receptacle.

2. The game apparatus of claim 1 including random means for determining which one of the plurality of standards at each playing position from which a playing object is to be blown toward said receptacle.

3. The game apparatus of claim 2 wherein said random means comprises a plurality of cards having indicia thereon and said standards are provided with complementary indicia thereat to determine which standard is to be selected by a player of the game for blowing the respective playing object therefrom.

4. A game apparatus, comprising:

a base support;

a plurality of playing objects coded for use by multiple players of the game;

means on said base support defining a receptacle for determining the first of said playing objects to be received therein, said receptacle being generally funnel in shape and having an aperture at the bottom thereof for receiving a single playing object to thereby determine which playing object is the first to be received therein;

a pluraity of upstanding standards at each playing position for positioning on top thereof a plurality of said coded playing objects; and said playing objects being of a physical character so as to be capable of being blown off of its respective standard by the exhalation by players of the from the top of the standards toward the receptacle.

5. The game apparatus of claim 4 including random means for determining which one of the plurality of standards at each playing position from which a playing object is to be blown toward said receptacle.

6. The game apparatus of claim 5 wherein said random means comprises a plurality of cards having indicia thereon and said standards are provided with complementary indicia thereat to determine which standard is to be selected by a player of the game for blowing the respective playing object therefrom.

7. The game apparatus of claim 6 wherein said playing objects are in the form of spherical structures or balls for rolling down said funnel to add a chance device to determine which playing object is the first to be received in the bottom of the funnel.

* * * * *